US007284470B2

(12) United States Patent
Huber et al.

(10) Patent No.: US 7,284,470 B2
(45) Date of Patent: Oct. 23, 2007

(54) BALLISTIC RESISTANT DEVICES AND SYSTEMS AND METHODS OF MANUFACTURE THEREOF

(75) Inventors: Christopher A. Huber, Butler, PA (US); Celeste L. Hort, Butler, PA (US); Francois Gamache, St. Lambert de Lauzon (CA)

(73) Assignee: Mine Safety Appliances Company, Pittsburgh, PA (US)

( * ) Notice: Subject to any disclaimer, the term of this patent is extended or adjusted under 35 U.S.C. 154(b) by 62 days.

(21) Appl. No.: 11/187,134

(22) Filed: Jul. 22, 2005

(65) Prior Publication Data

US 2007/0089596 A1 Apr. 26, 2007

(51) Int. Cl.
*F41H 5/04* (2006.01)
*F41H 5/08* (2006.01)
*F41H 1/02* (2006.01)

(52) U.S. Cl. ..... 89/36.02; 89/36.05; 2/2.5

(58) Field of Classification Search ..... 89/36.02, 89/36.05; 2/2.5
See application file for complete search history.

(56) References Cited

U.S. PATENT DOCUMENTS 2,404,739 A 7/1946 Mumma
3,828,699 A * 8/1974 Bowen ..... 109/80
4,732,803 A * 3/1988 Smith, Jr. ..... 428/212
5,340,633 A * 8/1994 van der Loo et al. ..... 428/114
5,759,664 A * 6/1998 Chisnell et al. ..... 428/109
6,253,655 B1 7/2001 Lyons et al.
6,500,507 B1 * 12/2002 Fisher ..... 428/36.1
6,510,777 B2 * 1/2003 Neal ..... 89/36.05
6,537,654 B1 * 3/2003 Gruber et al. ..... 428/293.4
6,601,497 B2 * 8/2003 Ghiorse et al. ..... 89/36.02
6,807,891 B2 * 10/2004 Fisher ..... 89/36.02
6,825,137 B2 * 11/2004 Fu et al. ..... 442/135
6,893,704 B1 * 5/2005 van der Loo ..... 428/107
6,899,009 B2 * 5/2005 Christiansen et al. ..... 89/36.02
6,912,944 B2 7/2005 Lucuta et al.
6,920,817 B2 * 7/2005 Ravid et al. ..... 89/36.11

* cited by examiner

*Primary Examiner*—Bret Hayes
(74) *Attorney, Agent, or Firm*—James G. Uber, Esq.; Henry E. Bartony, Jr., Esq.

(57) ABSTRACT

A projectile resistant device for use in armor includes a ceramic component; and at least a first component adhered to the ceramic component on at least one side thereof. Preferably the first component is a woven carbon fabric that is adhered to the back surface of the ceramic component. The projectile resistant device can further include at least a second component adhered to the front surface of the ceramic component. The second component preferably comprises a woven carbon fabric. The projectile resistant device can also include a retention layer adhered to the front surface of the second component. At least a portion of the retention layer extends around the edges of the second component, the ceramic component, and the first component and is adhered to the back surface of the first component. Preferably the retention layer is a woven fiberglass.

20 Claims, 8 Drawing Sheets

BALLISTIC RESISTANT DEVICES AND SYSTEMS AND METHODS OF MANUFACTURE THEREOF

BACKGROUND OF THE INVENTION

The present invention relates generally to ballistic resistant devices and systems and to methods of manufacture of such ballistic resistant devices and systems, and particularly, to ballistic resistant devices and systems for use in body armor and to methods of manufacture of such ballistic resistant devices and systems.

Ballistic resistant armor is used in many applications including, for example, protection of vehicles and persons from ballistic threats. Body armor to be worn on a person for protection from, for example, ballistic threats, has been available for several decades. In general, body armor protects vital parts of the human torso against penetration and severe blunt trauma from ballistic projectiles. In the development of body armor, there is a continuing effort to develop lighter, stronger, thinner, and more durable armor.

For example, monolithic and multi-component ceramic plates have been used in a number of hard body armors (that is, body armors including hard projectile resistant components or plates). See, for example, U.S. Pat. No. 6,253,655 and Canadian Patent No. 2,404,739. U.S. Pat. No. 6,253,655 discloses an armor including a durable spall cover for suppressing debris that would otherwise be ejected from the armor as a result of the impact of a projectile or missile on the armor. The spall cover of U.S. Pat. No. 6,253,655 also purportedly protects the ceramic or ceramic-based composite armor panels of U.S. Pat. No. 6,253,655 from sustaining damage when dropped onto a concrete surface. In one embodiment, the armor is a laminate including a polymer sheet outer layer, a flexible foam sheet or flexible honeycomb inner layer, a ceramic-based armor plate, and a fiber-reinforced plastic laminate backing. Adhesive layers bond each of the main layers to its adjacent layer or layers. When the armor is accidentally dropped or when an object impacts the polymer sheet outer layer at low velocity, the impact force is distributed by the polymer sheet outer layer to the flexible foam inner layer, which absorbs some of the kinetic energy. When a ballistic projectile such as a bullet strikes the polymer sheet, the projectile perforates the polymer sheet and is defeated by the armor plate. The ceramic layer in the armor literally breaks up the projectile; thus, absorbing a substantial amount of energy from the ballistic projectile. During the ballistic impact event, the ceramic will fracture into small pieces due to the reflective stress wave created by the impact of the ballistic projectile. These small pieces of ceramic are called spall and the flexible foam inner layer and the polymer sheet outer layer keep the resultant spall from ejecting out of the armor.

Canadian Patent No. 2,404,739 and its corresponding U.S. Pat. No. 6,912,944 disclose a ceramic armor system for personnel or vehicles that includes an integral ceramic plate or interconnected ceramic components. The ceramic has a deflecting front surface that includes one or more deflecting nodes. A shock-absorbing layer is bonded to the rear surface of the ceramic plate. The shock-absorbing layer can be formed of a polymer-fiber composite, including aramid fibers, carbon fibers, glass fibers, ceramic fibers, or polyethylene fibers. The shock absorbing layer can include layers of one type of fiber over another type of fiber in a suitable orientation that may be parallel to or at any other angle to one another. A front spall layer can be provided which is bonded to the front of the ceramic plate. The material adhered to the back of the ceramic plate/layer absorbs the residual energy of the ballistic projectile and also protects the wearer from blunt trauma created during the ballistic impact.

In general, ceramic materials used in armor systems are quite rigid and hard, while being relatively low in weight as compared to, for example, steel. Ceramic materials are also relatively resistant to abrasion, heat, chemical reaction and compression. Although substantial protection is provided by currently available body armor including ceramic plates from hits by one or a couple of ballistic projectiles, such body armor often fails upon receiving several more hits by ballistic projectiles.

It is desirable, therefore, to develop improved ballistic resistant devices that reduce or eliminate the above-identified and other problems associated with currently available ballistic resistant devices.

SUMMARY OF THE INVENTION

In one aspect, the present invention provides a projectile resistant device for use in armor including a ceramic component; and at least a first component adhered to the ceramic component on at least one side thereof. The first component preferably has a flexural modulus of at least 25 Msi and is adhered to a back surface of the ceramic component. The projectile resistant device can further include at least a second component adhered to a front surface of the ceramic component. The second component preferably has a flexural modulus of at least 25 Msi.

In one embodiment, the first component comprises a woven carbon fabric adhered to a back side of the ceramic component. The first component can also include at least a first layer, a second layer and a third layer of a woven carbon fabric. The second component can also include a woven carbon fabric.

In one embodiment, the first layer is adhered to the back surface of the ceramic component; the second layer is adhered to the back surface of the first layer, and the direction of a weave of the second layer is rotated to be of a different orientation than the direction of the weave of the first layer; and the third layer is adhered to the back surface of the second layer, and the direction of a weave of the third layer is rotated to be of a different orientation than the direction of the weave of the second layer. In one embodiment, the direction of the weave of the second layer is rotated approximately 30° about its axis in a first direction relative to the direction of the weave of the first layer. In this embodiment, the direction of the weave of the third layer is rotated approximately 60° about its axis in the first direction relative to the direction of the weave of the first layer.

The projectile resistant device can further include a retention layer that is adhered to the front surface of the second component and covers the front surface of the ceramic component. At least a portion of the retention layer extends around the edges of the other components (for example, the second component, the ceramic component and the first component) and is adhered to the back surface of the projectile resistant device. The retention layer is preferably fabricated from a material having a tensile strength of at least 100 ksi. The retention layer can, for example, include a woven fiberglass material. In one embodiment, the retention layer includes a plurality of portions that extend around the edges of the other components and are to be adhered to the back surface of the projectile resistant device.

The projectile resistant device can also include a backing component. Preferably, the backing component includes a first backing layer which is adhered to the back surface of the first component, a second backing layer adhered to the back surface of the first backing layer, and a third backing layer adhered to the back surface of the second backing layer. Each of the first backing layer and the third backing layer preferably have a stiffness greater than the second backing layer. The second or intermediate backing layer preferably exhibits greater energy absorption properties than each of the first backing layer and the third backing layer.

In one embodiment, the first backing layer comprises multiple laminated layers of a fist grade of woven high molecular weight polyethylene fibers. The second backing layer in this embodiment can include multiple laminated layers of a second grade of woven high molecular weight polyethylene fibers. The third backing layer in this embodiment can include multiple laminated layers of the first grade of woven high molecular weight polyethylene fibers.

The retention layer as described above can be adhered to the front surface of the second component to cover the front surface of the second component and include at least a portion that extends around the edges of the second component, the ceramic component, the first component and the backing layer and is adhered to a back surface of the third backing component.

The projectile resistant device can further include a protective shell comprising a polymeric material. The protective shell can include a front wall. The front surface of the retention layer can be adhered to the back surface of the front wall. The protective shell further includes side surfaces extending back from the front surface to encompass sides of the retention layer, the first component, the ceramic component, the second component and the backing component.

In another aspect, the present invention provides a projectile resistant device for use in armor including a projectile resistant component comprising a ceramic component and at least another component in operative connection with the ceramic component. A retention layer is adhered to the front surface of the projectile resistant component. At least a portion of the retention layer extends around the edges of the projectile resistant component and is adhered to the back surface of the projectile resistant component. The retention layer preferably includes a material having a tensile strength of at least 100 kpsi. The retention layer can, for example, include a woven fiberglass fabric.

In a further aspect, the present invention provides a projectile resistant device for use in armor including a ceramic component; and a backing component in operative connection with the rear surface of the ceramic component. The backing component preferably includes a first backing layer, a second backing layer adhered to the back surface of the first backing layer, and a third backing layer adhered to the back surface of the second backing layer. Each of the first backing layer and the third backing layer has a stiffness greater than that of the second backing layer. The second backing layer has greater energy absorption properties than each of the first backing layer and the third backing layer.

In still a further aspect, the present invention provides a projectile resistant device including a ceramic component. A first component is adhered to a back surface of the ceramic component. The first component preferably includes at least a first layer, a second layer and a third layer of a woven carbon fabric. Each of the first layer, the second layer and the third layer of woven carbon fabric has a flexural modulus of at least 25 Msi. The direction of the weave of the second layer is preferably rotated approximately 30° about its axis in a first direction relative to the direction of the weave of the first layer. The direction of a weave of the third layer is preferably rotated approximately 60° about its axis in the first direction relative to the direction of the weave of the first layer. A second component is adhered to the front surface of the ceramic component. The second component preferably comprises at least one layer of a woven carbon fabric. The woven carbon fabric has a flexural modulus of at least 25 Msi. A backing component including a first backing layer is adhered to the rear surface of the first component. A second backing layer is adhered to the back surface of the first backing layer. A third backing layer is adhered to the back surface of the second backing layer. Each of the first backing layer and the third backing layer has a stiffness greater than that of the second backing layer. The second backing layer has greater energy adsorption properties than the first backing layer and the third backing layer. A retention layer is adhered to the front surface of the second component. The retention layer covers the front surface of the second component. A plurality of portions of the retention layer extend around the edges of the second component, the ceramic component, the first component, and the backing component and are adhered to the back surface of the backing component. The retention layer preferably comprises a woven fiberglass material having a tensile strength of at least 100 ksi. The projectile resistant device further includes a protective shell of a polymeric material. The protective shell has a front wall. The front surface of the retention layer is adhered to the back surface of the front wall. The protective shell further includes side surfaces extending back from the front surface to encompass sides of the retention layer, the first component, the ceramic component, the second component and the backing component.

The body armor of the present invention provides substantially improved multiple-strike resistance as compared to currently available body armor. In that regard, the body armor of the present invention can withstand eight 0° obliquity impacts from a 5.56 mm IP round at velocities up to 940 m/s and up to five impacts of a 7.62 mm AP round at velocities up to 485 m/s. To the knowledge of the present inventors, currently available body armor can withstand only three 5.56 rounds and only three 7.62 rounds, respectively.

BRIEF DESCRIPTION OF THE DRAWINGS

Other aspects of the present invention and advantages thereof will be discerned from the following detailed description when read in connection with the accompanying drawings, in which.

DETAILED DESCRIPTION OF THE INVENTION

Figure 1B:
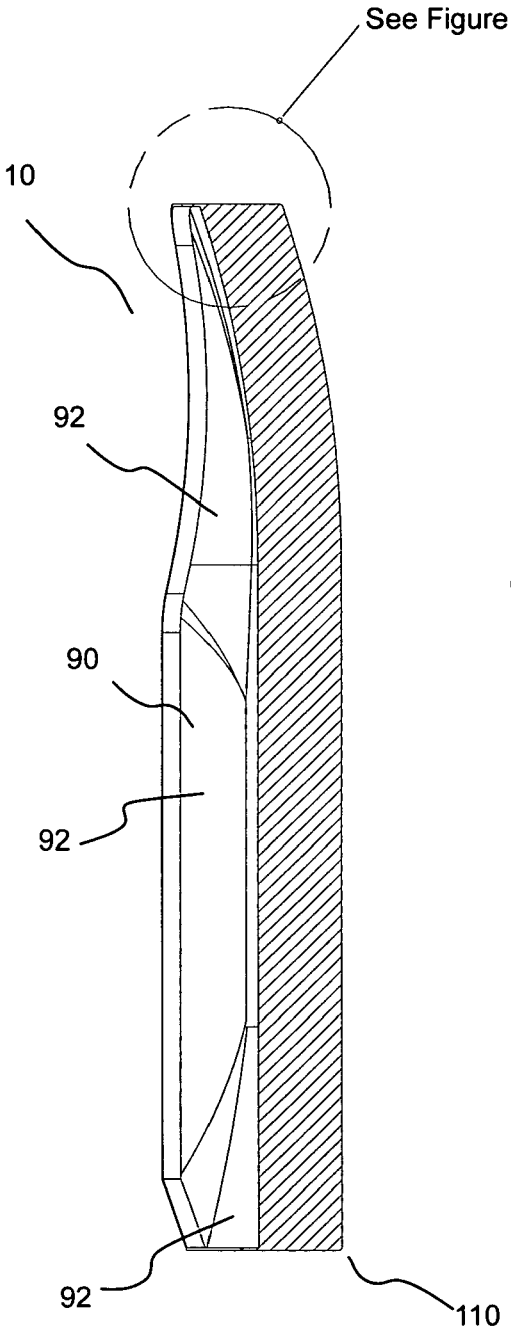
FIG. 1B is a side, cross-sectional view of the body armor of FIG. 1A.
Figure 1A:
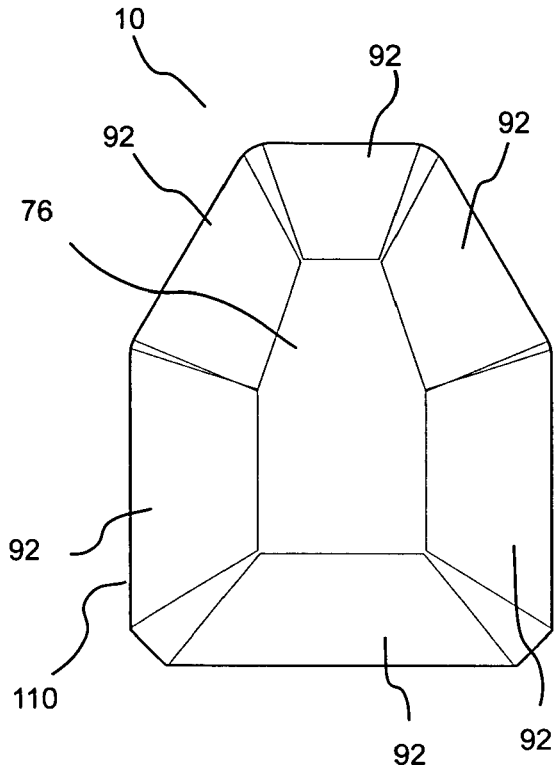
FIG. 1A is a rear view of an embodiment of a body armor of the present invention.
Figure 1C:
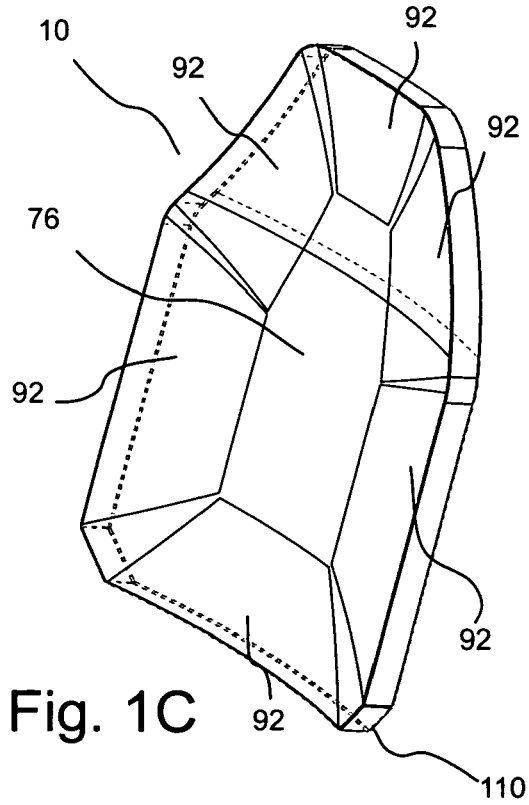
FIG. 1C is a rear perspective view of the body armor of FIG. 1A.
Figure 1D:
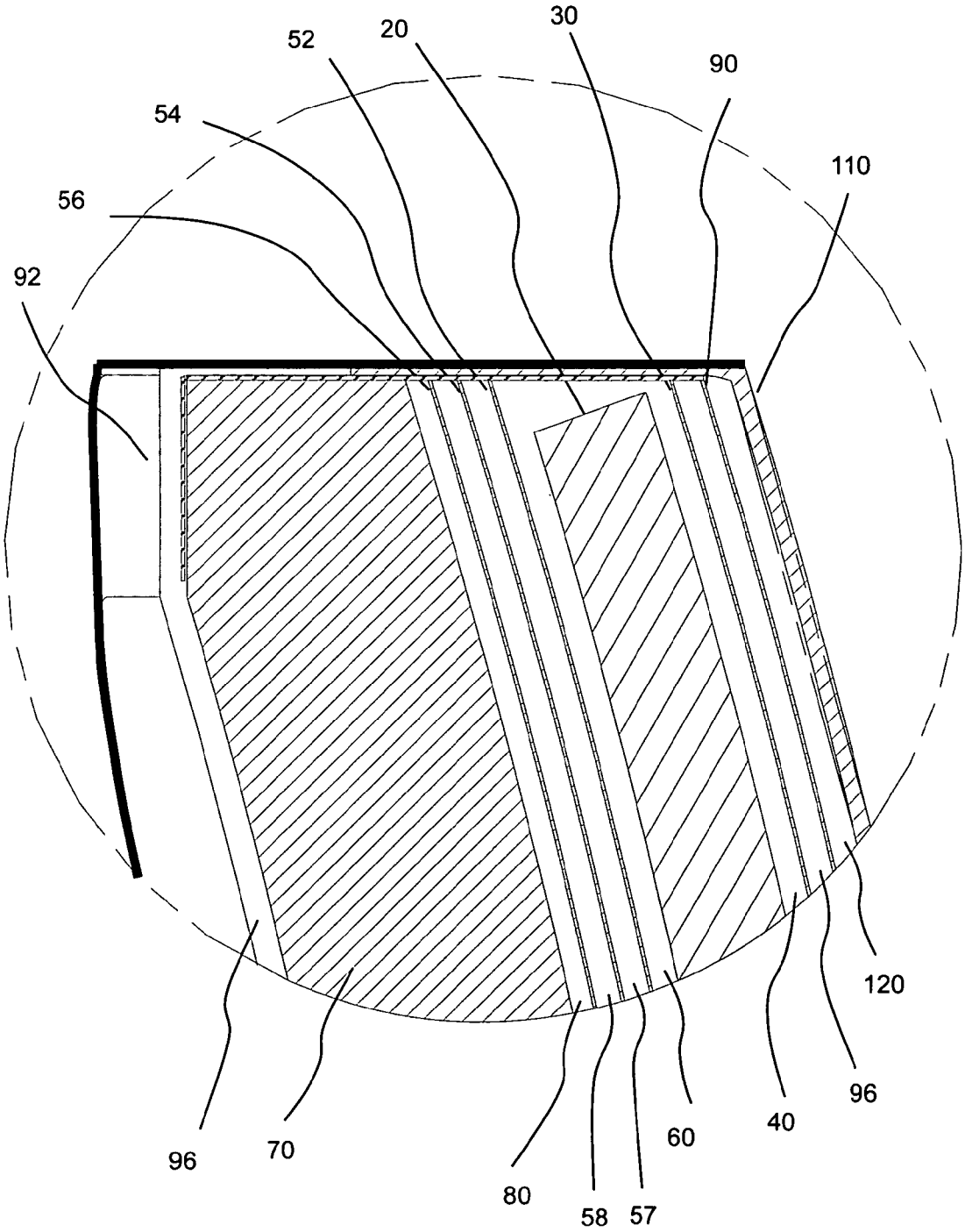
FIG. 1D is an enlarged, side cross-sectional view of the encircled portion of the body armor of FIG. 1B.
Figure 1E:
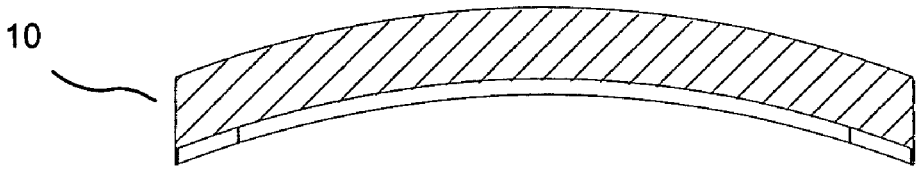
FIG. 1E is a bottom, cross-sectional view of the body armor of FIG. 1A.
Figure 1F:
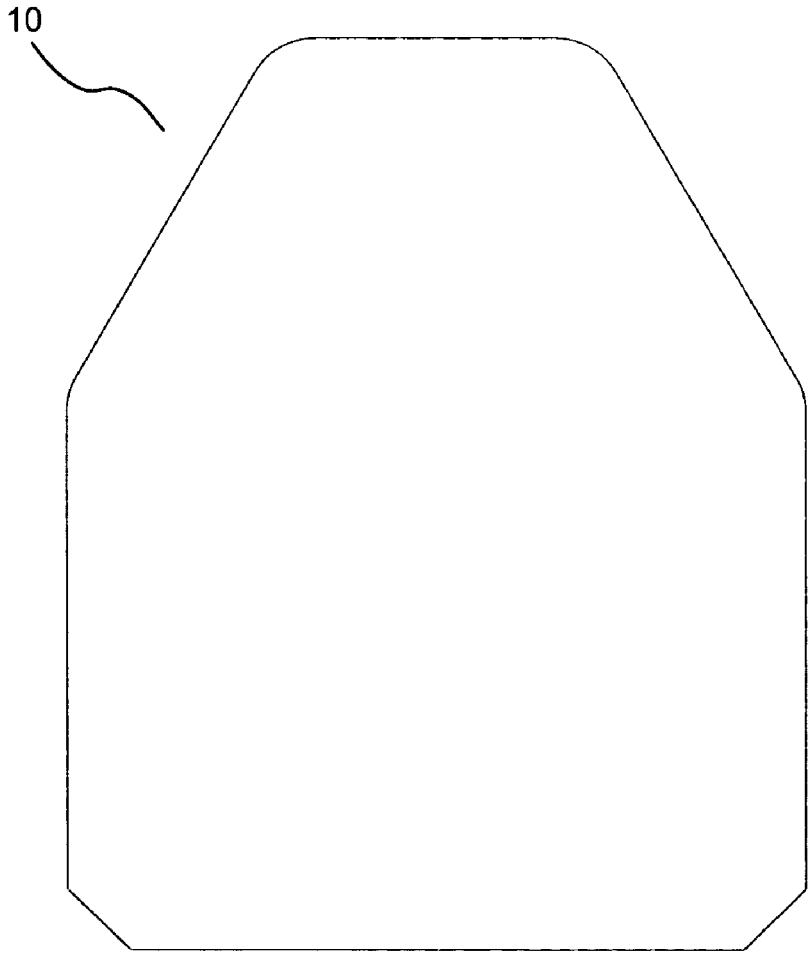
FIG. 1F is a front view of the body armor of FIG. 1A.
Figure 2E:
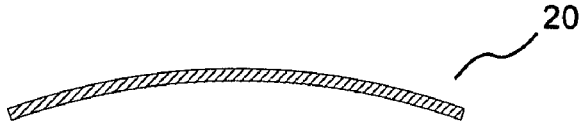
FIG. 2E is a bottom cross-sectional view of the ceramic component of FIG. 2A.
Figure 2D:
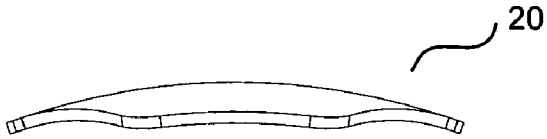
FIG. 2D is a top view of the ceramic component of FIG. 2A.
Figure 2B:
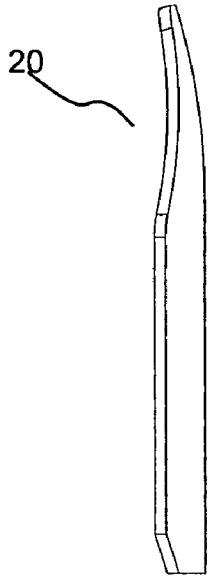
FIG. 2B is a side view of the ceramic component of FIG. 2A.
Figure 2A:
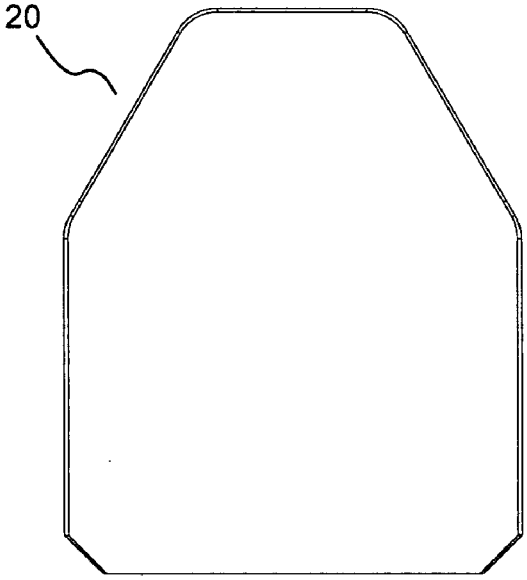
FIG. 2A is a front view of an embodiment of a ceramic component of the body armor of FIG. 1A.
Figure 2C:
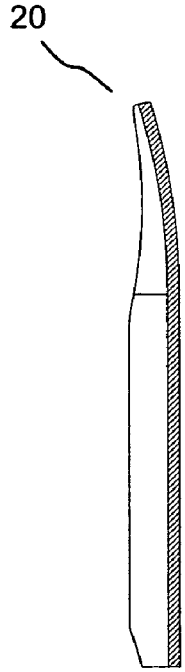
FIG. 2C is a side cross-sectional view of the ceramic component of FIG. 2A.
Figure 3:
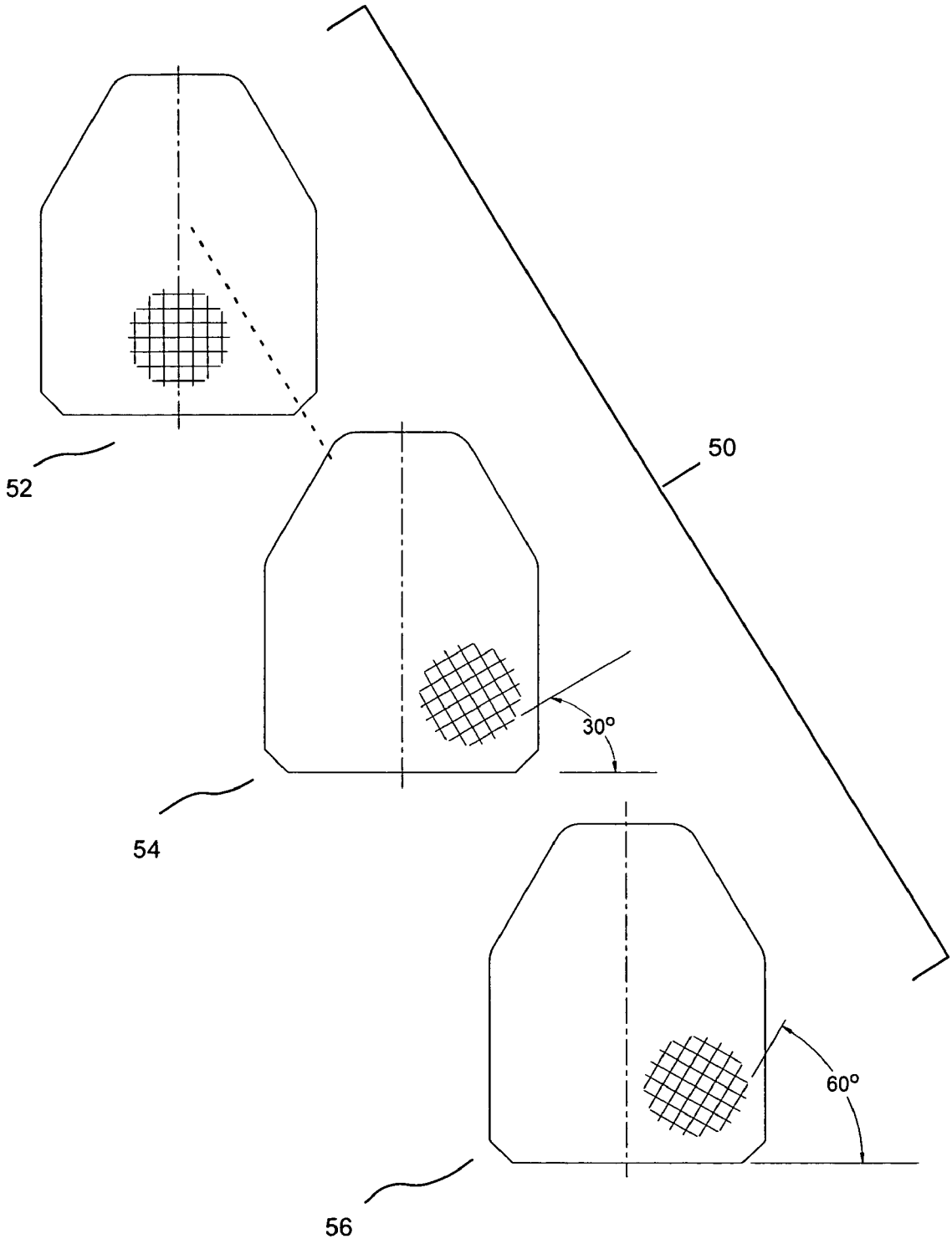
FIG. 3 is a front view of the three carbon fabric layers of the first component of the body armor of FIG. 1A.

In general, the ballistic resistant devices of the present invention are well suited to protect vital portions of the human torso against penetration and severe blunt trauma as can, for example, be caused by small caliber rounds and armor piercing projectiles. Unlike currently available ballistic resistant devices, the ballistic resistant devices of the present invention are particularly suited to sustain multiple hits from ballistic threats. In several studies of the ballistic resistant devices and body armor of the present invention, the ballistic resistant devices defeated eight 5.56 mm rounds at point blank range and five 7.62 mm armor piercing rounds at a range of 250 meters.

In the embodiment illustrated in FIGS. 1-6C, armor 10 includes a ballistic plate 10 of a ceramic material as the primary projectile-stopping component. In the illustrated embodiment, a monolithic, curved ceramic component or plate 20 (see FIGS. 1D and 2A-2E) was used that matched generally the curved contour of the human torso. In one embodiment of the present invention, a 98% pure alumina ceramic material was used in ceramic component 20. Several currently available armor systems including ceramic components or plates use silicon carbide or boron carbide ceramic composites, which, although harder than alumina ceramic materials, cost up to 10 times that of alumina. Other currently available armor systems including ceramic components or plates use alumina plates of less purity than that used in the armor of the present invention. Use of an alumina ceramic having a purity less than the purity of the alumina ceramic of the present invention, would require a greater thickness of ceramic component to provide an equivalent projectile stopping ability, which increases the size and weight of the integrated ballistic plate. Preferably, alumina of at least approximately 98% purity is used in armor 10 of the present invention. Use of such alumina ceramic material provides the advantage of lower weight for the same ballistic performance versus armor which uses alumina of lesser purity.

In one embodiment, a component including at least one layer 30 (see FIG. 1D) of relatively hard material (such as a plain woven carbon fabric) was adhered to a front (strike) surface of ceramic component 20 using an adhesive 40 such as an epoxy adhesive. In the illustrated embodiment, another layer 50 of a relatively hard material was adhered to a back surface of ceramic component 20. Preferably, the material(s) for front layer 30 and back layer 50 have a flexural modulus or stiffness and number of filaments of at least 25 Msi (or 25,000,000 psi) and at least 3000 filaments per strand of yarn, respectively. More, preferably the material(s) have a modulus of at least 33 Msi and at least 6000 filaments per strand of yarn. The stiffness or modulus of the carbon fabric is much higher than other woven fabric such as polymer-fiber composite, fiberglass and aramids by weight. This stiffness assists in providing the appropriate support for the back of the ceramic component or plate. The stiffness of each of the carbon layers is significant in that it must hold the ceramic together during multiple ballistic impacts. As described above, the number of filaments per strand of yarn is preferably at least 3000. However, 6000 filaments is more preferred because the resulting carbon fabric layer will have a higher ratio of carbon filaments to epoxy; thus, improving the stiffness on a per weight basis. The weave of the carbon fabric can, for example, be twill, a plain, a unidirectional, or a basket weave. Preferably, the weave is either plain or twill. The carbon fabrics used in several studies of the present invention were obtained from Barrday, Inc. of Ontario, Calif.

In one embodiment, layer 50 included three layers or sheets 52, 54 and 56 (see, for example, FIGS. 1D and 3) of twill weave carbon fabric. Layer 50 was adhered to a back surface of ceramic plate 20 using an adhesive 60 such as an epoxy adhesive. Layers 52, 54 and 56 were adhered to each other using adhesive layers 57 and 58 such as an epoxy adhesive. The adhesive chosen for several studies was a high peel strength rubber toughened epoxy. The adhesive (for example, epoxy) used between the carbon fabric layers preferably has a peel strength of greater than 50 PIW (pounds per inch width, as per ASTM D1876-61T). Peel strengths lower than 40 PIW can reduce the multi-hit performance. Front layer 30 and back layer 50 were found to function together to reinforce ceramic plate 20 and reduce crack propagation during multiple ballistic impacts. Front layer 30 and back layer 50 enabled a single alumina ceramic plate to withstand a higher number of multiple hits from a ballistic projectile as compared to ceramic plates provided in currently available body armor.

In a preferred embodiment, the weave of each of layers 52, 54 and 56 of carbon fabric of back layer 50 is oriented differently. In that regard, during assembly of several body armors 10 studied in the present invention, the weave direction of each layer 52, 54 and 56 of carbon fabric was rotated approximately 30° relative to the weave direction of the adjacent layer. In that regard, if the orientation of the weave of layer 52 was defined as approximately 0°, the orientation of layer 54 was approximately 30° and the orientation of layer 56 was approximately 60°. Orienting the weaves of layers 52, 54 and 56 in this fashion caused the carbon fabric assembly or back layer 50 to have an acoustical impedance characteristic which sufficiently matched that of ceramic component 20; thereby reducing rebounding pressure waves which damage the ceramic around the impact point and produce ejected spall. By mitigating such damage to the ceramic component 20, contact time between the projectile and the ceramic (also known as dwell time) is increased allowing the ceramic to better erode the projectile and reduce its velocity; thus enhancing the overall stopping power of the armor 10 without adding a significant amount of weight. Rotating the orientation of the weave of each layer 52, 54 and 56 of carbon fabric increased the stiffness of back layer 50; thus, increasing the ability of back layer 50 to support ceramic component 20 during ballistic impact. During multiple ballistic impacts, front layer 30 and multioriented, composite carbon back layer 50 reduced crack propagation from one impact zone to another. Prior to the present invention, certain non-ceramic layers were included in armor in addition to the ceramic component to, for example, minimize crack propagation and spall or absorb shock. However, such non-ceramic layers did not provide a substantial increase in overall projectile stopping power. In addition to reducing crack propagation, carbon fabric front layer 30 and carbon fabric back layer 50 of the present invention enable the thickness of ceramic component 20 to be decreased (thereby reducing overall weight), while accomplishing the task of preventing multiple projectiles from penetrating armor 10.

Armor 10 can also include a backing component or panel 70 (see FIGS. 1D and 4A-4C) fabricated from multiple layers of one or more materials. Backing panel 70 is adhered to the back surface of the back layer 50 using an adhesive 80 such as urethane adhesive. Backing panel 70 functioned, in part, to provide additional projectile stopping capacity and to catch debris/spall liberated from the armor assembly during a projectile impact. The peel strength between the layers of ballistic fabric in backing panel 70 (discussed further below) is important and the ultimate stiffness of backing panel 70 can affect the multi-hit capability of ceramic component 20 and, ultimately, the system. The peel strength of adhesive between the layers of fabric in several of the studies of the present invention was between approximately 4 psi, and 10 psi. To reduce and preferably minimize blunt trauma to the torso of the person equipped with armor 10, backing panel 70 also preferably functions to distribute the impact force over a wider area than the tip of the projectile.

Figure 4C:
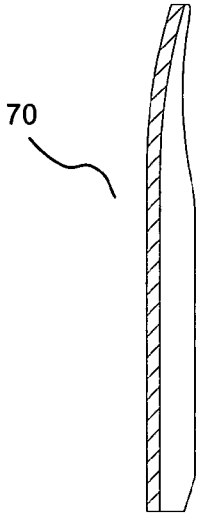
FIG. 4C is a side, cross-sectional view of the assembled backing layer of FIG. 4A.
Figure 4B:
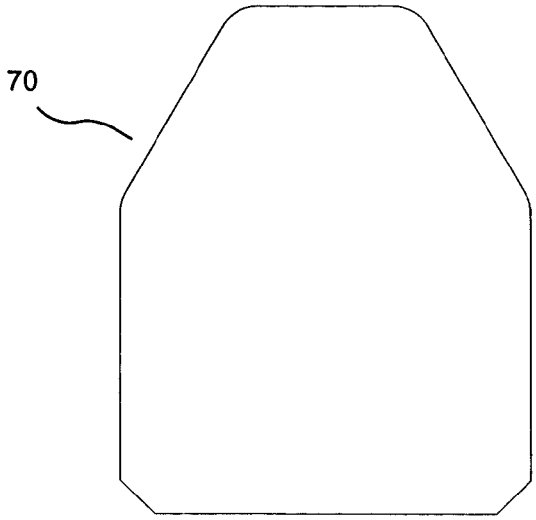
FIG. 4B is a front view of the assembled backing layer of FIG. 4A.
Figure 4A:
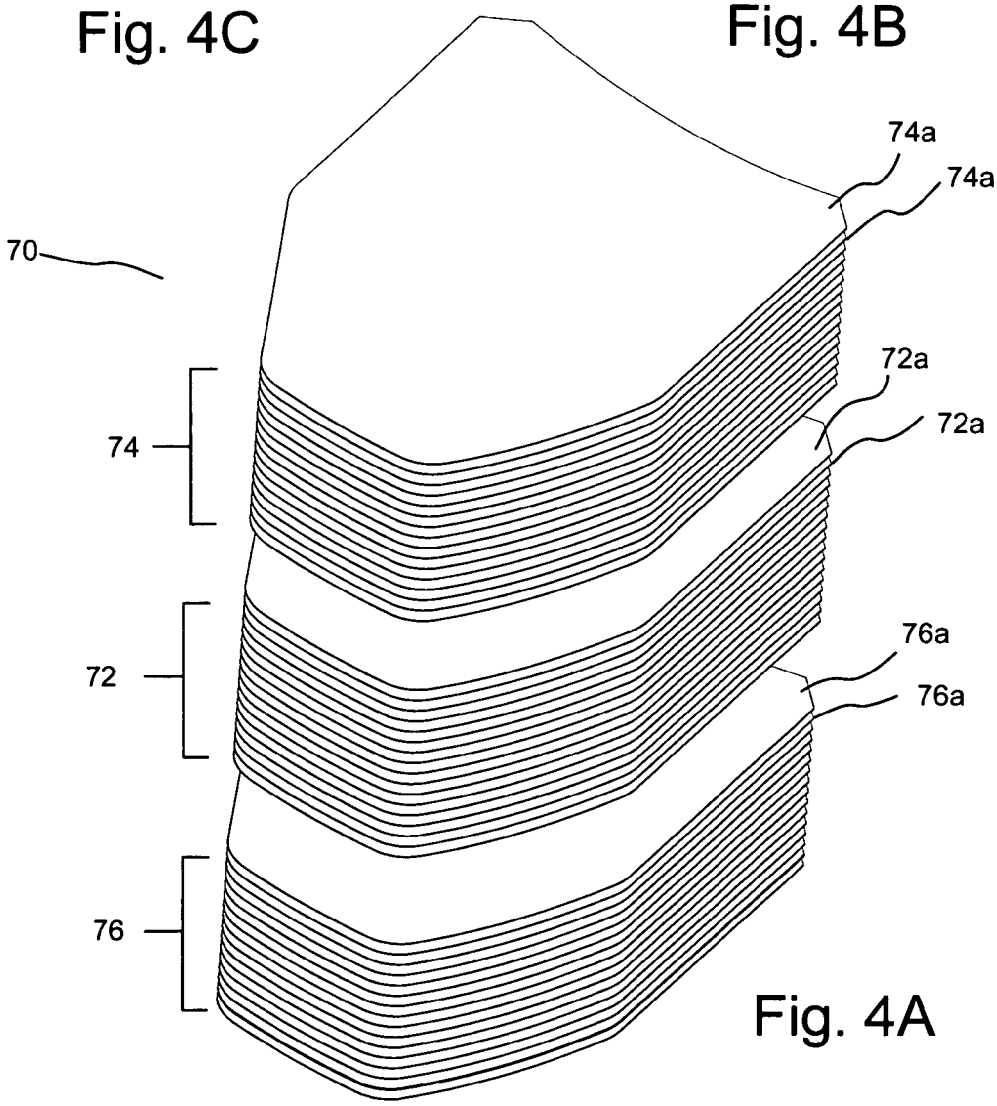
FIG. 4A is an exploded, perspective view of an embodiment of a multi-layer backing component of the body armor of FIG. 1A.
Figure 5:
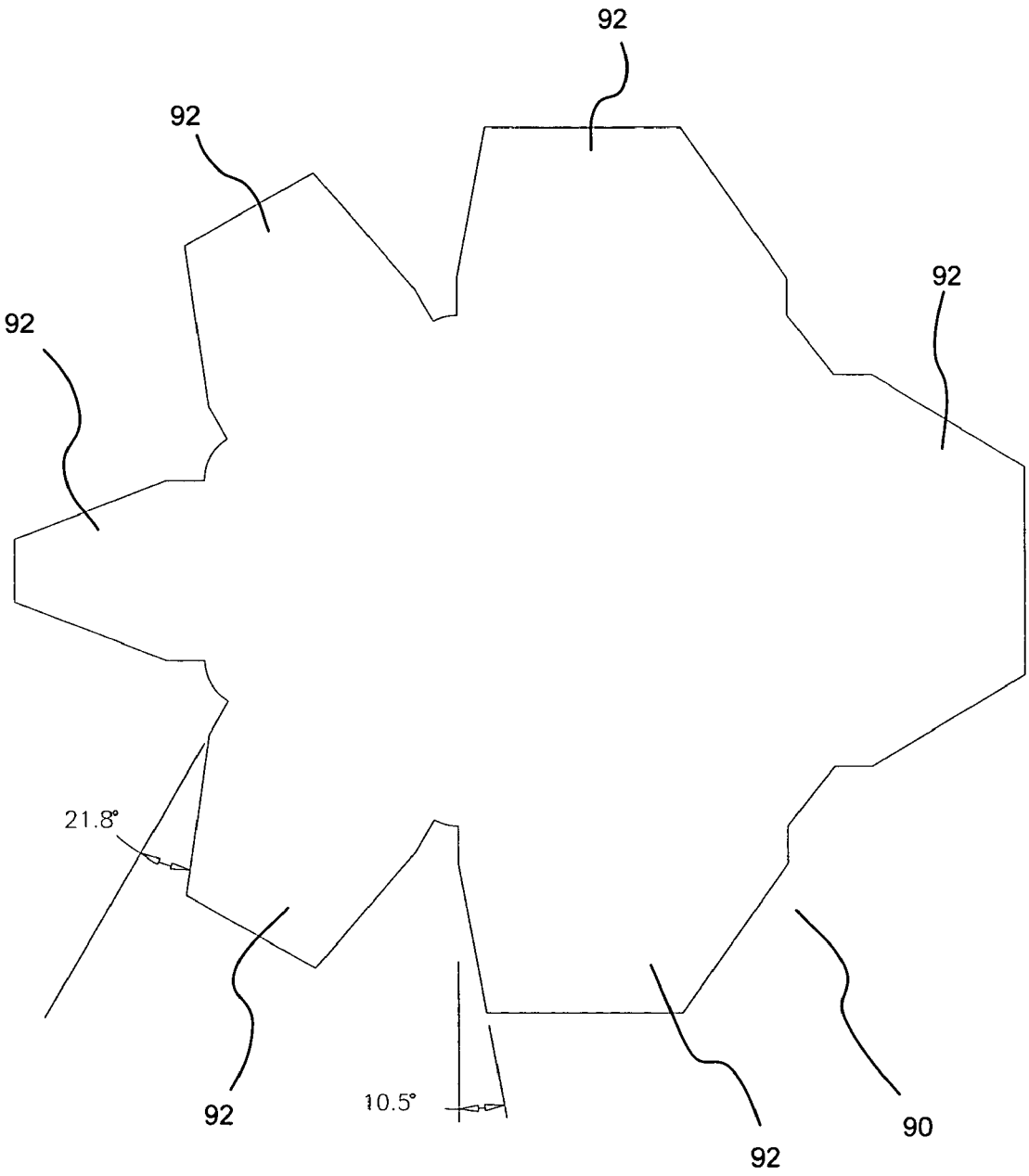
FIG. 5 is a front view of an embodiment of a retention layer of the body armor of FIG. 1A.
Figure 6A:
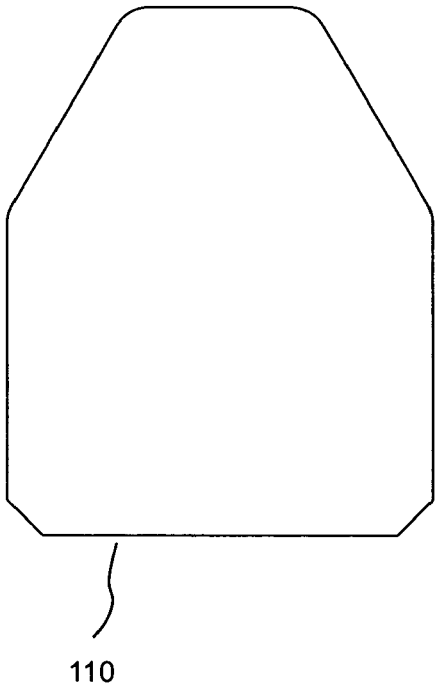
FIG. 6A is a front view of an outer shell of the body armor of FIG. 1A.
Figure 6B:
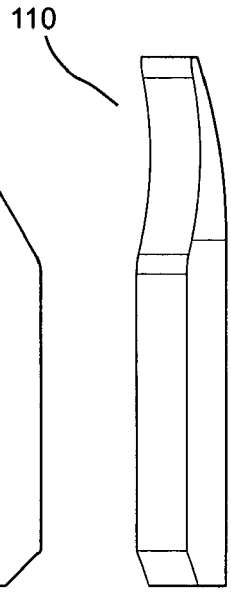
FIG. 6B is a side, cross-sectional view of the outer shell of FIG. 6A.
Figure 6C:
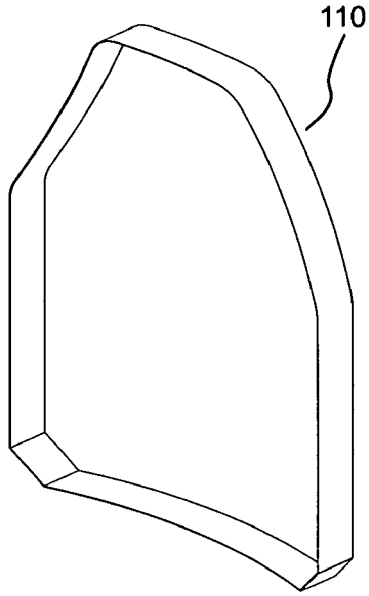
FIG. 6C is a rear perspective view of the outer shell of FIG. 6A.

In one embodiment, multiple layers or sheets woven from ultra-high molecular weight polyethylene material such as SPECTRA® 900 available from Honeywell of Virginia, USA were used. In one such embodiment, the woven sheets were SPECTRA SENTINEL® fabric (woven quasi-unidirectional, ballistic resistant fabrics used in combination with a resin system for soft or hard armor) available from Barrday, Inc. of Ontario, Canada. As illustrated in FIG. 4A, in one embodiment, backing panel 70 included multiple sheets of two different grades of SPECTRA SENTINEL materials which were heated, stacked and pressed together. In the embodiment illustrated in, for example, FIG. 4A, a layer 72 including 18 layers 72*a* of SPECTRA grade 0, a 6.3±0.3 oz/yd$^2$ fabric, were sandwiched between two layers 74 and 76 of SPECTRA grade 1, a 3.7±0.4 oz/yd$^2$ fabric, material. Each of layers 74 and 76 included 16 layers 74*a* and 76*a* of SPECTRA grade 1. The two different grades of material in layers 72, 74 and 76 provided two different stiffnesses. Layer 74 (SPECTRA grade 1) preferably exhibits a higher stiffness which makes it highly effective in stopping a projectile that has penetrated front layer 30, ceramic component 20 and back layer 50. Likewise, layer 76 (SPECTRA grade 1) also preferably exhibits a higher stiffness which makes it highly effective in stopping a projectile that has additionally penetrated layer 74 and layer 72. Intermediate layer 72 (SPECTRA grade 0) is less stiff, but provides greater energy absorption (for example, via delamination) than layers 74 and 76. Layer 72 operates to slow debris and to absorb momentum. Once again, rear layer 76 (SPECTRA grade 1) material, with its higher stiffness, absorbs any remaining impact energy and distributes the force over a wide area; thus ultimately reducing blunt force trauma to the wearer. Backing panel 70 thereby offers additional ballistic performance enhancement with the addition of little weight. Test data for the present invention showed that performance is enhanced with the described sandwich configuration beyond that obtained by other stacking of such materials, for example, a simple one-for-one (that is, grade 1/grade 0/grade 1/grade 0, etc) layering or 18/32 (18 grade 1 layers over 32 grade 0 layers) stacking. The 18/32 stack for example has a different impedance than the 16/18/16 embodiment. The impedance or modulus of backing panel 70 further aids in supporting the ceramic plate and ultimately the armor system.

The unique stacking arrangement of backing panel 70 results in impedance variations selected to work against the changing requirements of a ballistic event as it progresses through armor 10. Backing layers (that is, layers of material to the rear of a ceramic component) in currently available armor including a ceramic component are designed only to capture exiting spall and to distribute force. Such currently available armor relies solely upon the ceramic component to stop the projectile.

In one embodiment, woven fiberglass retention layer or component 90 (see, for example, FIGS. 1C, 1D and 5) was adhered to the front surface of the front layer 30. Retention layer 90 preferably functions, in part, to slow and capture spall (debris liberated from the front surface of armor 10 during a ballistic impact). Spall, if not deterred, poses the threat of injury to anyone close to armor 10. Spall of a size or velocity that does not penetrate a 0.6-mm thick sheet of 3003 H14 aluminum would not likely cause serious injury. Fiberglass retention layer 90 in the present invention was found to stop spall resulting from the impact of a 7.62 mm×51 mm FMJ Ball Round traveling at 660 m/s. Spall mitigation layers are common in ballistic armor. However, in the present invention, fiberglass retention layer 90 has a secondary function. In that regard, fiberglass retention layer 90 was dimensioned to wrap around other components (that is, front component 30, ceramic component 20, back component 50 and backing layer 70) to assist in maintaining the overall integrity of the armor. Retention layer 90 preferably includes a plurality of portions or flaps 92 that extend around the edges or sides of front component 30, ceramic component 20, back component 50 and backing component 70 and were adhered to a back surface of backing component 70 using, for example, a urethane adhesive 96. In several studies of the present invention, fiberglass retention layer 90 was preferably between approximately 0.010 and 0.020 inches thick. More preferably, fiberglass retention layer 90 was between approximately 0.015 and 0.020 inches thick.

The advantage provided by this configuration was apparent when the armor 10 was subjected to multiple ballistic impacts. Being wrapped within fiberglass retention layer 90, the projectile-stopping components and backing layer 70 were held tightly together or retained against the repeated ballistic impact forces which act to separate the projectile-stopping components from backing layer 70. Furthermore, a significant portion of the projectile's energy is redirected into overcoming the relatively high sheer and tensile strength of the bonded fiberglass layer 90, thereby allowing a greater number of impacts before armor 10 is too badly damaged to provide effective protection. A high sheer strength urethane adhesive 96 was used to bond fiberglass retention layer 90 to front layer 30 and to backing layer 70. The peel strength of the adhesive 96 used to bond retention layer 90 to other layers is preferably at least 10 psi, more preferably at least 16 psi and, more preferably, at least 32 psi.

Retention layer 90 can be fabricated from materials other than woven fiberglass. Preferably such materials exhibit a relatively high tensile strength as described above. In that regard, materials for retention layer 90 preferably have a tensile strength (the maximum tensile stress that may be sustained before a material will rupture) of at least 100 ksi (or 100,000 psi). More preferably, the material of retention layer 90 has a tensile strength of at least 150 ksi. Even more preferably, the material of retention layer 90 has a tensile strength of at least 200 ksi. The weave of the material for retention layer 90 can, for example, be a plain, twill, or basket weave; and is preferably, a twill weave. The weave type for retention layer 90 is important because a stiff weave or a weave with low drapeability will not wrap around the armor system components appropriately. The type of fiberglass used in several studies of the present invention was an e-glass. However, other fiberglass such as s-glass can also be used. The s-glass tensile strength is higher than the e-glass tensile strength, but it is typically more expensive. The material of retention layer 90 (for example, fiberglass) preferably exhibits an elongation in the range of approximately 2-5%. More preferably, the elongation is approximately 3%.

In general, the integrity of currently available armor is lost relatively quickly as a result of delamination caused by multiple ballistic impacts. The ability of such currently available armor to stop projectiles and to distribute load is thereby severely decreased. To the contrary, in the armor 10 of the present invention, the wrapping of retention layer 90 provides improved resistance against delamination by requiring the projectile's energy to also overcome the sheer and tensile forces provided by retention layer 90.

A preformed outer shell 110 (see, for example, FIGS. 1D and 6A-6C) encompassed the front and sides of the other components of armor 10. In one embodiment, a pre-formed etched or non-filler type polycarbonate outer shell 110, approximately 1/32" thick, was adhered to fiberglass retention layer 90 using an adhesive 120 such as a urethane adhesive. Shell 110 was shaped to conform to the compound contours of ceramic component 20 and included side walls around the periphery thereof which extend back or rearward to cover the side edges of the components of armor 10. During assembly, shell 110 acts as a fixture or form to hold the other components of armor 10 in place as they were added to the assembly and as the armor assembly was pressed. During use of armor 10, shell 110 also protects the front and side edges of the other components of armor 10 against abrasion and incidental puncture or snagging. The peel strength of adhesive 120 used to bond the shell 110 to retention layer 90 is preferably at least 10 psi, more preferably at least 16 psi and, even more preferably, at least 32 psi. Adhesion of, for example, urethane can be improved by etching the polycarbonate prior to bonding.

The integration of the components of armor 10 was accomplished through the use of compression molding without heating.

Although the present invention has been described in detail in connection with the above embodiments and/or examples, it should be understood that such detail is illustrative and not restrictive, and that those skilled in the art can make variations without departing from the invention. The scope of the invention is indicated by the following claims rather than by the foregoing description. All changes and variations that come within the meaning and range of equivalency of the claims are to be embraced within their scope.

What is claimed is:

1. A projectile resistant device, comprising: a ceramic component;

at least a first component adhered to the ceramic component on at least one side thereof, the first component having a flexural modulus of at least 25 Msi, wherein the first component is adhered to a back surface of the ceramic component;

at least a second component adhered to a front surface of the ceramic component, the second component having a flexural modulus of at least 25 Msi; and a backing component comprising a first backing layer which is adhered to a back surface of the first component, a second backing layer adhered to a back surface of the first backing layer, and a third backing layer adhered to a back surface of the second backing layer, each of the first backing layer and the third backing layer having a stiffness greater than the second backing layer, the second backing layer having greater energy absorption properties than each of the first backing layer and the third backing layer.

2. The projectile resistant device of claim 1 wherein the first component comprises woven carbon fabric adhered to a back surface of the ceramic component.

3. The projectile resistant device of claim 2 wherein the first component comprises at least a first, layer, a second layer and a third layer of a woven carbon fabric.

4. The projectile resistant device of claim 3 wherein the first layer is adhered to the back surface of the ceramic component, the second layer is adhered to a back surface of the first layer and a direction of a weave of the second layer is rotated to be of a different orientation than a direction of the weave of the first layer, and the third layer is adhered to a back surface of the second layer and a direction of a weave of the third layer is rotated to be of a different orientation than a direction of the weave of the second layer.

5. The projectile resistant device of claim 4 wherein the direction of the weave of the second layer is rotated approximately 30° about its axis in a first direction relative to the direction of the weave of the first layer and the direction of the weave of the third layer is rotated approximately 60° about its axis in the first direction relative to the direction of the weave of the first layer.

6. The projectile resistant device of claim 1 wherein the second component comprises woven carbon fabric.

7. The projectile resistant device of claim 6 wherein the first component comprises woven carbon fabric.

8. The projectile resistant device of claim 1 wherein the first backing layer comprises multiple laminated layers of a first grade of woven high molecular weight polyethylene fibers, the second backing layer comprises multiple laminated layers of a second grade of woven high molecular weight polyethylene fibers, and the third backing layer comprises multiple laminated layers of the first grade of woven high molecular weight polyethylene fibers.

9. The projectile resistant device of claim 1 further comprising a retention layer covering a front surface of the second component such that at least a portion of the retention layer extends around an edge of each of the second component, the ceramic component, the first component and the backing layer and is adhered to a back surface of the third backing component, the retention layer comprising a material having a tensile strength of at least 100 kpsi.

10. The projectile resistant device of claim 9 wherein the retention layer comprises a woven fiberglass material.

11. The projectile resistant device of claim 10 wherein the retention layer comprises a plurality of portions that extend around the edges of the second component, the ceramic component and the first component and are adhered to a back surface of the projectile resistant device.

12. The projectile resistant device of claim 9 wherein the retention layer comprises a woven fiberglass fabric.

13. The projectile resistant device of claim 9 wherein the retention layer comprises a plurality of portions that extends around the edges of the second component, the ceramic component, the first component and the backing component and are adhered to a back surface of the third backing layer.

14. The projectile resistant device of claim 9 further comprising a protective shell comprising a polymeric material, the protective shell having a front wall, the front surface of the retention layer being adhered to a back surface of the front wall, the protective shell further comprising side surfaces extending back from the front surface to encompass the edges of the retention layer, the first component, the ceramic component, the second component and the backing component.

15. The projectile resistant device of claim 1 further comprising a retention layer covering a front surface of the second component such that at least a portion of the retention layer extends around an edge of each of the second component, the ceramic component, the first component and the backing layer and is adhered to a back surface of the third backing component, the retention layer comprising a material having a tensile strength of at least 100 kpsi.

16. A ballistic resistant armor, comprising: a ceramic component;

a first component adhered to a back surface of the ceramic component, the first component comprising at least a first layer, a second layer and a third layer of a woven carbon fabric, each of the first layer, the second layer and the third layer of woven carbon fabric having a flexural modulus of at least 25 Msi, a direction of a weave of the second layer being rotated approximately 30°0 about its axis in a first direction relative to a direction of the weave of the first layer and the direction of a weave of the third layer being rotated approximately 60° about its axis in the first direction relative to the direction of the weave of the first layer;

a second component adhered to a front surface of the ceramic component, the second component comprising a woven carbon fabric having a flexural modulus of at least 25 Msi;

a backing component comprising a first backing layer which is adhered to a rear surface of the first component, a second backing layer adhered to a back surface of the first backing layer, and a third backing layer adhered to a back surface of the second backing layer, each of the first backing layer and the third backing layer having a stiffness greater than the second backing layer, the second backing layer having greater energy adsorption properties than the first backing layer and the third backing layer;

a retention layer covering a front surface of the second component such that a plurality of portions of the retention layer extends around an edge of each of the second component, the ceramic component, the first component, and the backing component and are adhered to a back surface of the backing component, the retention layer comprising a woven fiberglass material having a tensile strength of at least 100 ksi; and a protective shell comprising a polymeric material, the protective shell having a front wall, the front surface of the retention layer being adhered to a back surface of the front wall, the protective shell further comprising side surfaces extending back from the front surface to encompass the edges of the retention layer, the first component, the ceramic component, the second component and the backing component.

17. The ballistic resistant armor of claim 16 wherein the retention layer comprises a woven fiberglass material.

18. The ballistic resistant armor of claim 1 wherein the retention layer comprises a plurality of portions that extend around the edges of the second component, the ceramic component and the first component and are adhered to a back surface of the projectile resistant device.

19. The ballistic resistant armor of claim 16 wherein the first backing layer comprises multiple laminated layers of a first grade of woven high molecular weight polyethylene fibers, the second backing layer comprises multiple laminated layers of a second grade of woven high molecular weight polyethylene fibers, and the third backing layer comprises multiple laminated layers of the first grade of woven high molecular weight polyethylene fibers.

20. The ballistic resistant armor of claim 16 wherein the retention layer comprises a plurality of portions that extends around the edges of the second component, the ceramic component, the first component and the backing component and are adhered to a back surface of the third backing layer.

* * * * *